US006780084B2

(12) United States Patent
Moellenberg, Jr. et al.

(10) Patent No.: US 6,780,084 B2
(45) Date of Patent: Aug. 24, 2004

(54) METHOD FOR HONING BLIND BORES IN WORKPIECES

(75) Inventors: Richard F. Moellenberg, Jr., St. Louis, MO (US); John J. Schimweg, St. Louis, MO (US); David M. Moehn, Alton, IL (US)

(73) Assignee: Sunnen Products Company, St. Louis, MO (US)

( * ) Notice: Subject to any disclaimer, the term of this patent is extended or adjusted under 35 U.S.C. 154(b) by 0 days.

(21) Appl. No.: 10/378,306

(22) Filed: Mar. 3, 2003

(65) Prior Publication Data

US 2003/0129928 A1 Jul. 10, 2003

Related U.S. Application Data

(62) Division of application No. 09/337,108, filed on Jun. 21, 1999, now Pat. No. 6,527,620.

(51) Int. Cl.[7] ..... B24B 33/04

(52) U.S. Cl. ..... 451/5; 451/470; 51/338; 364/474.23

(58) Field of Search ..... 451/5, 464, 470, 451/478; 51/338, 340, 343, 350, 339; 364/474.23, 474.21, 191, 171, 167.01, 474.06, 188–193

(56) References Cited

U.S. PATENT DOCUMENTS 4,075,794 A * 2/1978 Blaylock ..... 451/472
4,099,350 A * 7/1978 Hasty ..... 451/470
4,173,852 A * 11/1979 Fitzpatrick ..... 451/487
4,223,485 A * 9/1980 Largeteau ..... 451/487
4,275,530 A * 6/1981 Largeteau ..... 451/487
4,462,189 A * 7/1984 Puybaraud ..... 451/470
4,765,096 A * 8/1988 Lang ..... 451/124
4,887,221 A * 12/1989 Davis et al. ..... 700/181
5,050,352 A * 9/1991 Estabrook et al. ..... 451/463
5,185,969 A * 2/1993 Vanderwal, Jr. ..... 451/470
5,371,978 A * 12/1994 Higashikawa ..... 451/51
5,390,448 A * 2/1995 Schimweg ..... 451/478
5,529,529 A * 6/1996 Judge et al. ..... 451/51

* cited by examiner

*Primary Examiner*—Joseph J. Hall, III
*Assistant Examiner*—Anthony Ojini
(74) *Attorney, Agent, or Firm*—Haverstock, Garrett & Roberts LLP

(57) ABSTRACT

A device for honing blind bores in parts, a blind bore including a cylindrical bore open at one end and closed adjacent to the opposite end including a honing mandrel for mounting on a honing machine that produces rotation thereof, the mandrel having a cylindrical honing portion adjacent one end which portion and the adjacent portion of the mandrel have spaced axially extending slot therethrough to enable the honing portion of the mandrel to expand and contract in size, the honing portion having a portion adjacent to the end thereof which is somewhat larger than the rest of the honing portion when the honing portion is expanded for honing in the blind hole, the end portions of the mandrel between the spaced slots being elastically expandable from a retracted position which is less than the diameter of the surface to be honed to enable insertion therein to a more expanded condition wherein the diameter of the honing portion at the largest point is the diameter at which the mandrel will hone the blind hole. The present invention also includes a method for programming the operation of the device to produce the desired honing operations when honing blind holes.

12 Claims, 5 Drawing Sheets

METHOD FOR HONING BLIND BORES IN WORKPIECES

This application is a division of U.S. patent application Ser. No. 09/337,108, filed Jun. 21, 1999, now U.S. Pat. No. 6,527,620.

FIELD OF INVENTION

The present invention relates to a honing tool which is specifically constructed and used to accurately hone blind bores or holes located in workpieces. A blind bore is a bore that does not go all the way through the workpiece and because of this the tool and method of using the tool must be modified from the more conventional honing tool which rotates and expands as it is stroked and moves back and forth in the workpiece. In the more conventional honing tool, the honing mandrel is expanded by pushing a wedge shaped member against the member or members on which the abrasives are located to move them radially outwardly into engagement with the work surface while also maintaining them in a cylindrical condition. This is not possible with blind holes because with a blind bore the tool cannot reciprocate in the ordinary manner and usually must be retracted to enter the bore before the honing operation commences and the expansion of the honing member or mandrel is reversed from the usual method so as to enable a portion of one end of the honing portion to expand outwardly more than the other positions thereof to enable the mandrel to hone a cylindrical surface to the desired diameter and to do so over the entire length of the blind hole.

Since a blind bore does not go all the way through the part or workpiece, the honing or finishing of a blind bore is usually relatively difficult because the honing tool cannot pass all the way through the bore or hole and beyond and therefore stroking in the usual way is difficult or impossible. Typically, the obstructed end of the workpiece usually has some type of relief or undercut area. The size and length of the relief area is usually not necessarily critical but the length of the undercut can be important because the length determines the amount of over stroke which can be accomplished when attempting to finish a blind bore to the same final size along the full length and with minimum taper. In the past, the honing of blind holes often used a single stroke procedure, but even this would produce some inaccuracy and would often require that the bore be rehoned by a second, third or more stroking without producing a taper of some kind. When honing with a tool that strokes back and forth, the stroking of the tool beyond the end of the workpiece bore into the relief area is usually required if the operation is to be successful and accurate. If there is not adequate relief for a long enough over stroke at the closed end of the bore, a barrel shaped bore often occurs in the surface being honed and this will produce a bore that is not cylindrical along its full length.

When using a single stroke honing tool, the tool is generally tapered for removing the material. The nature of this type of tool typically makes the final size of the bore smaller at the bottom or closed end as compared to the rest of the bore length. This is true because the size of the relief is usually not large enough to allow the bottom or closed end of the workpiece bore to be properly honed to its desired final size.

The present invention is directed to a honing tool and method of use specifically designed to hone blind bores to the same desired final size or diameter along the entire length of the bore surface. In this case, the tool is designed so as to be operated in a reverse manner as compared to a typical honing tool. More specifically, the present tool is designed so as to be positioned within the blind bore to be honed in its retracted condition, that is, at a dimension that is less than the dimension of the bore, and is then expanded while at or near the bottom or closed end of the blind bore to a particular size and pulled or drawn out of the blind bore while rotating at a controlled feed rate to achieve the final diameter which is uniform along the length of the bore. Depending upon the amount of material to be removed in this manner, this honing operation can be accomplished with a single pass or with multiple passes as will be described later.

The present tool includes an elongated substantially tubular member having an opening or passageway extending the entire length thereof and adaptable for insertably receiving an elongated expander member or wedge positioned for axial movement therein. The tubular member includes inner and outer surfaces, at least a portion of the outer surface at one end including an abrasive material thereon for accomplishing the honing operation, while the inner surface of at least that portion of the tool that corresponds to the outer abrasive portion is conically tapered over substantially the entire length of the abrasive portion as will be explained later and shown in the drawings. In contrast with the conventional honing devices the expander member or wedge assembly in the present construction has an outer surface which is conically tapered over at least a portion of its length at or near the same taper rate as the conical taper associated with that portion of the inner surface of the tubular honing member where the outer abrasive surface is located. This means that when the expander member is positioned within the tubular member, the tapered outer surface of the expander member can move into surface-to-surface contact with the tapered inner surface of the tubular honing member.

The tubular honing member also includes one or more slots extending from the end thereof along and beyond the abrasive portion of said member to permit expanding and contracting the abrasive portion of the honing member when the wedge is advanced or retracted axially therein. The present tool also includes means associated with one end portion thereof for mounting the tool to a rotatable member or spindle on a honing machine so that the tool can be rotated about its axis of rotation during a honing operation. In similar manner, the expander member or wedge assembly engages and is axially moved by means on the honing machine which are operable to move the wedge axially to change the diameter of the outer surface of the abrasive portion of the honing member. The abrasive portion of the present tool can have any desired pattern or configuration and, importantly, includes at least one lead-in or cutting taper near the lead end which is designed to remove most of the material during a particular honing stroke. The present honing tool is constructed to be retracted before insertion into the blind bore, and thereafter is expanded and pulled back through the hole while rotating. The cutting taper is usually slight and located at or near the free end of the abrasive portion of the tool. In other words, the cutting taper is such that the largest diameter is at or adjacent the free end of the abrasive portion of the tool as is shown in the accompanying drawings. This is different from conventional honing tools where the honing portion is cylindrical over its entire length.

The present tool may include a plurality of lead-in tapers such as first and second tapers, the second taper being positioned and located immediately following the first taper and being of a taper rate which is less than the taper rate of the first taper. The second or later taper portion can be followed by a substantially cylindrical abrasive portion, and the cylindrical abrasive portion can be followed by a reverse taper portion if desired. Any combination of tapers and cylindrical honing sections can be utilized in a particular tool depending upon the particular application.

Furthermore, if there are a plurality of slots associated with the present honing tool, this enables it to more uniformly expand and contract and the slots may take several different forms including being of straight or helical configurations. The same is true of the honing surfaces which may take helical, straight or other shapes that extend around the outer surface of the honing portion of the tool. The use of nonlinear grooves or flutes in the abrasive portions of the honing member also provide means for the circulation of honing oil or coolant during the honing operation which often times is an advantage. The tool needs to be formed of a relatively elastic material so that it can retract when the wedge is withdrawn and can expand when the wedge is advanced.

The method for using the subject tool is also new and enables the machine operator to manually or otherwise program the honing of blind bores by positioning the mandrel in its retracted condition so that it can enter the unhoned bore without touching or rubbing on the wall of the bore during entry. The tool is then moved to adjacent to the bottom or closed end of the bore and once properly positioned, the tool is expanded and rotated at a controlled rate. The amount of time that the tool remains in the bottom or closed end position before moving can be used to allow the material at the closed end of the bore to be removed by the tool before vertical or axial movement of the tool begins. The expanded rotating tool is then pulled out of the workpiece at an appropriate rate which will ensure that the workpiece bore is honed to the same size over its entire length. If the amount of material removed during a single pass of the tool through the bore is less than the total amount of material which must be removed from the bore to reach the desired size this process can be repeated with the tool expanded out further for each succeeding pass until the desired final dimension is reached. The entire sequence can be programmed so as to allow the operator to move the tool to any desired position in the bore at different rates and different numbers of times in order to bring the workpiece surface up to the desired size. The expanding and contracting of the tool can take place at different rates and the speed of rotation of the tool can also be varied depending upon the nature of the abrasive material used and the material of the surface being honed. Typical abrasives include plated diamond and borozon particles and various metal bonded abrasives. In a computer operated machine, the starting and final diameters can be preprogrammed as well as the other operating conditions such as the length of the bore, the material from which the workpiece is made, and the type of abrasive material that is being used and other parameters as will be described. The present method will size and finish the blind bores to precise tolerances without the tolerance levels degrading the even wear of the tool. This then is a honing method that does not fail because of uneven wear of the tool.

OBJECTS OF THE INVENTION

It is a principal object of the present invention to provide means to enable a honing machine to be used to accurately hone blind bores.

Another object of the present invention is to enable existing honing machines to be programmed to hone blind bores.

Another object is to enable existing honing machines to be modified to enable them to hone in blind bores.

Another object is to enable accurately honing blind bores by inserting a retracted honing mandrel into the bore being honed and expanding it when fully inserted so that when it is drawn out of the bore while rotating, it will hone the surface to the same dimension over its full length.

Another object is to teach a novel method for honing blind bores which can make use of some existing technology.

These and other objects and advantages of the present invention will become apparent after considering the following detailed description of the present invention in connection with the accompanying drawings.

SUMMARY OF THE INVENTION

The present invention relates to a novel apparatus which can be used to accurately hone blind bores which are bores that are open at one end but blocked at or adjacent to the opposite end. The present invention also relates to the method of programming and using the same apparatus for honing blind bores.

DETAILED DESCRIPTION OF THE INVENTION

Figure 1:
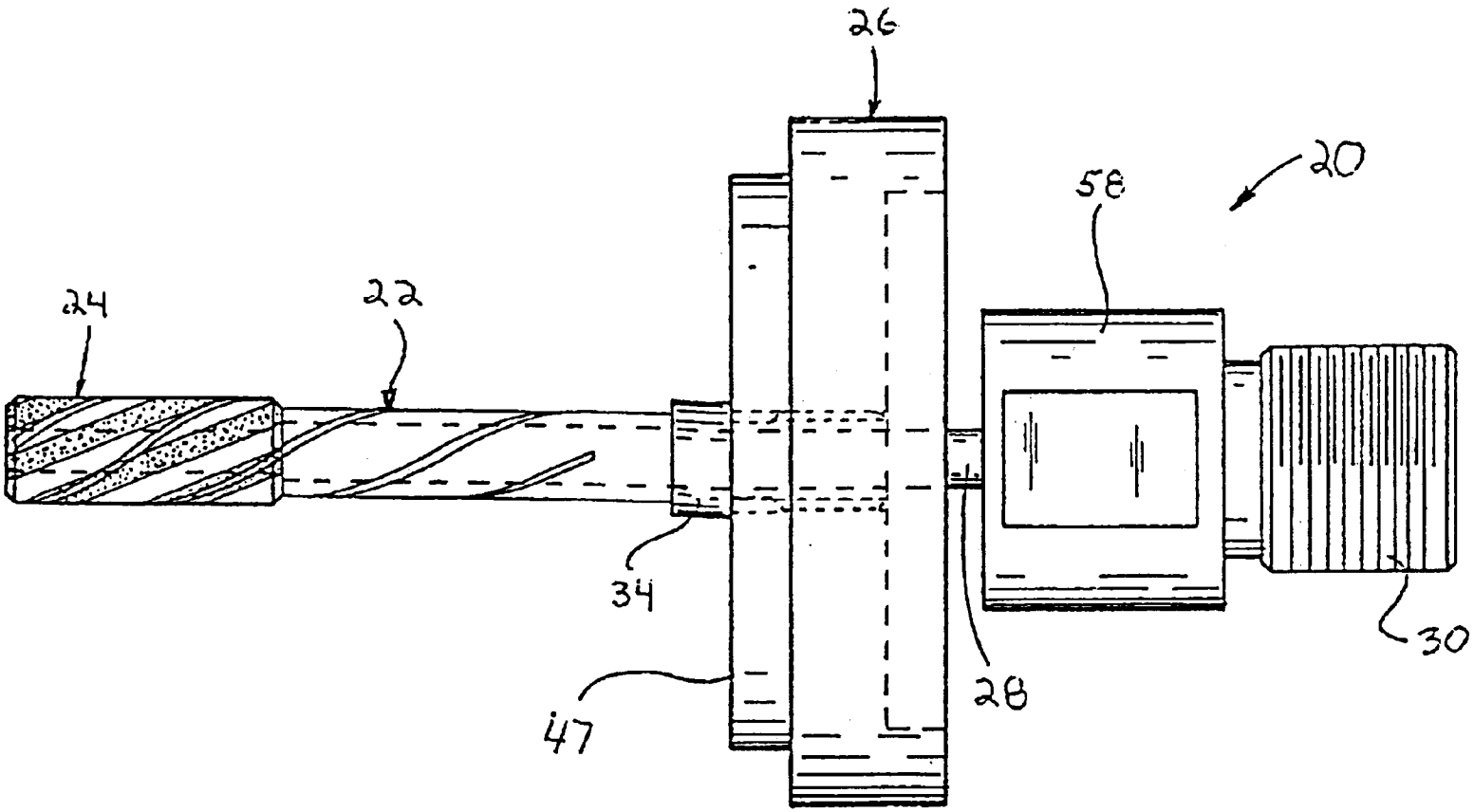
FIG. 1 is a side elevational view of a honing mandrel constructed according to the present invention and designed specifically to hone blind bores such as the blind bore shown in FIG. 9.

Referring to the drawings by reference numbers, FIG. 1 shows a honing mandrel assembly 20 constructed according to the present invention. The assembly 20 includes a honing member or mandrel 22 having an expandable abrasive end portion 24 on one end thereof. The honing portion 22 extends into and is attached to a hub portion 26 which not only attaches to the honing member 22 but also has a passage for receiving an expander member or wedge 28, which wedge extends through the honing portion 24 of the mandrel 22 and also extends to an opposite enlarged end portion 30 which is attached to means on a honing machine that are used during a honing operation to move the wedge 28 to expand or retract the honing portion 24 of the mandrel 22 at the appropriate times and to the appropriate sizes. The hub portion 26 of the present device is also attached to a honing machine and is connected to means that rotate the mandrel.

Figure 2:
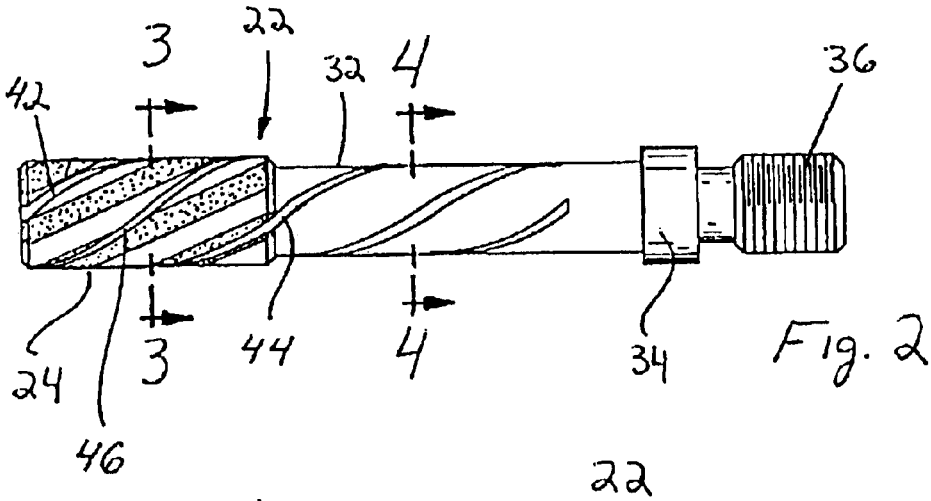
FIG. 2 is a side elevational view of the honing member used in the construction shown in FIG. 1.
Figure 3:
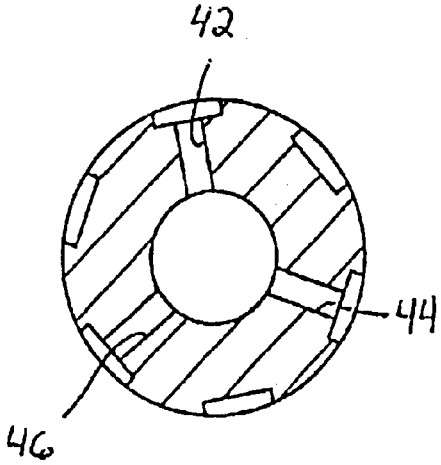
FIG. 3 is a cross-sectional view taken along line 3—3 of FIG. 2.
Figure 4:
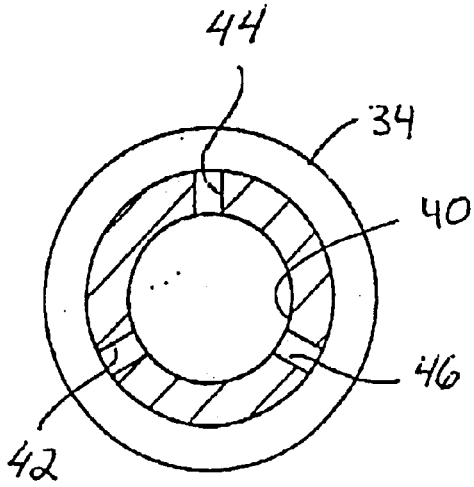
FIG. 4 is a cross-sectional view taken along line 4—4 of FIG. 2.

Referring to FIG. 2, the mandrel 22 shown therein includes the honing portion 24 and an integral tubular portion 32, a locating portion 34 and a threaded end portion 36. The mandrel 22 is tubular over its entire length and has a conical surface portion 38 which extends through the honing portion 24, and another connecting cylindrical surface portion 40 which extends from the larger end of the tapered bore portion 38 to the opposite end of the mandrel. In the construction as shown in FIGS. 1 and 2 the honing portion 24 and the adjacent portion of the mandrel have circumferentially spaced slots 42, 44, and 46 which extends therethrough. In the embodiment as shown, the slots are equally spaced 120° apart and each of the slots is shown having a curved or helical shape although other shapes could be used instead, including axially extending slots. FIGS. 3 and 4 are cross-sectional views of the mandrel taken at different locations, and each of these views shows the positions of the slots 42, 44 and 46 at their respective locations.

Figure 8:
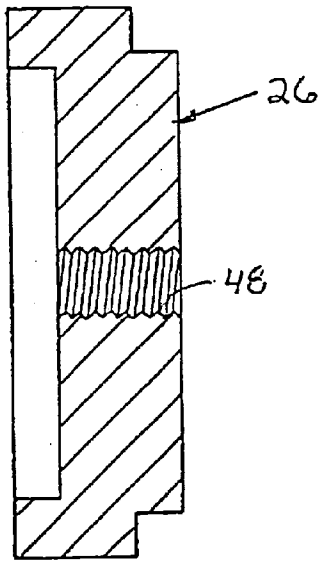
FIG. 8 is a cross-sectional view taken along line 8—8 of FIG. 7.
Figure 7:
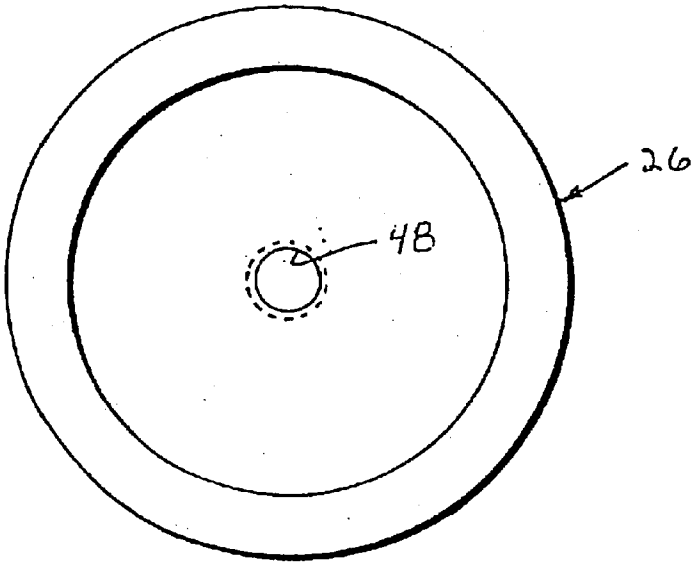
FIG. 7 is a front view of the hub portion of the mandrel shown in FIG. 1.

The enlarged diameter portion 34 of the mandrel 22 abuts the forward end, or face 47 of the hub portion 26 and the threaded portion 36 of the mandrel 22 threadedly engages the bore 48 in the hub portion 26 as shown in FIG. 8.

Figure 6:
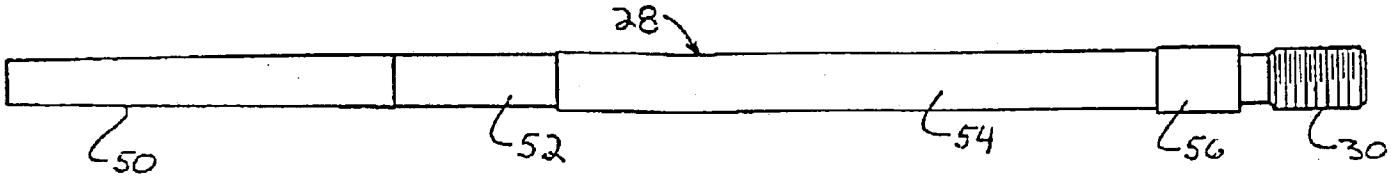
FIG. 6 is a side view of the wedge member as shown in FIG. 1.

FIG. 6 shows the details of the wedge member 28. The wedge member 28 has a conically tapered end portion 50 which extends from the free end thereof a distance which exceeds the axial length of the honing portion 24. The tapered portion 50 is connected to a cylindrical portion 52 which in turn is connected to another cylindrical portion 54, the opposite end of which is connected to an enlarged portion 56. The portion 56 extends through a block member 58 (FIG. 1) and from there it extends to the threaded end portion 30. The end portion 30 is connected to means on a honing machine or the like which controls the operation of the portion 30 and in turn adjusts the axial position of the wedge member 28 relative to the mandrel 22.

Figure 9:
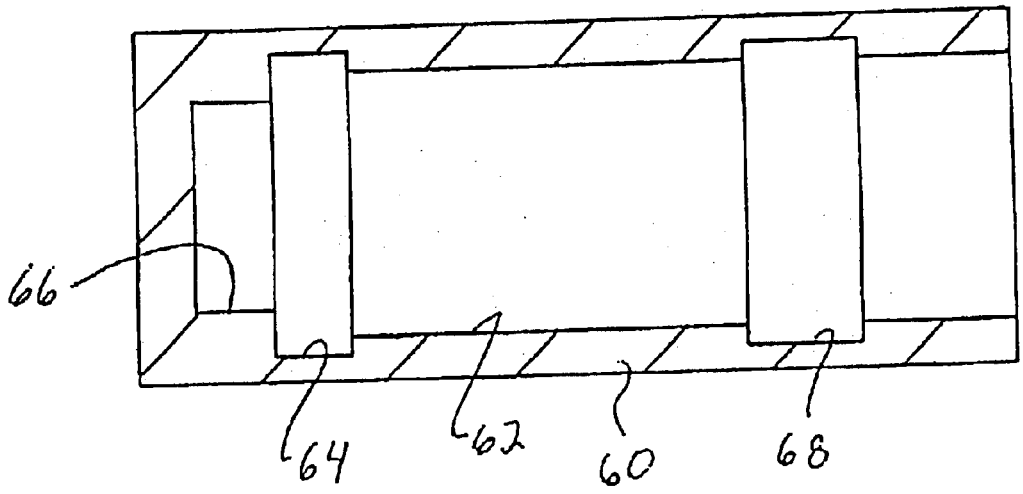
FIG. 9 is a cross-sectional view of a blind bore of the type that is honed by the construction shown in FIGS. 1–8.

FIG. 9 is a cross-sectional view of a typical workpiece 60 having a blind bore 62 located therein. The surface of the blind bore 62 extends to an enlarged bore portion 64 at the closed end thereof. The member 60 may also have a further extension such as extension 66 which is shown aligned with the closed or blind end of the bore 62. Another enlargement 68 is shown adjacent the inlet end of the bore 62 although neither of the portions 66 or 68 needs to be included for the bore to be a blind bore suitable for honing by a mandrel and machine of the types which is disclosed herein.

In order to hone with the subject blind hole or bore mandrel, it is necessary to position the workpiece with the open end of the blind bore in axial alignment with the abrasive end portion 24 of the mandrel 22. Depending upon the material of which the part to be honed is made and the type of abrasive to be used, the operation of the mandrel can be adjusted. It is first necessary to move the free end of the mandrel into the blind bore with the wedge member withdrawn sufficiently so that the free end portion 24 of the honing member 22 between the slots 42, 22 and 46 will be retracted. While in the retracted position, the mandrel will be inserted into the blind bore sufficiently far so that the free end of the abrasive portion 24 is at, near to, or beyond the closed or blind end of the bore. When this positioned has been reached, the mandrel will be adjusted as to size by moving the wedge member 28 axially in and through the honing portion 24 which causes the tapered end portion 50 of the wedge to move against the conical inner surface 38 of the honing portion 24 expanding them outwardly into engagement with the surface of the blind bore. The honing pressure and the dimensions can be made as selected. While this is being done, the honing mandrel will be rotated to the desired rotating speed so that when the expansion is complete, the mandrel will engage and hone the bore. Once the expansion of the mandrel has been completed at the closed end of the bore, the mandrel will be rotated and drawn outwardly from the bore until it has been completely withdrawn. It should be noted that by moving the wedge member far enough through the mandrel, the free end portions of the mandrel will be enlarged to some degree relative to the rest of the mandrel, and this means that the greater diameter will occur at or near the free end of the honing portion 24 as will be described later in connection with FIG. 10. When the mandrel has been withdrawn from the blind bore, the honing operation may be completed or it may not be completed. If it is not completed, the surface being honed will still be under sized and the process described above can be repeated as many times as necessary as by retracting the wedge member 28, reinserting the mandrel into the blind bore, expanding the diameter, rotating the mandrel while again withdrawing it from the blind bore. This process can be repeated as many times as necessary to reach the desired bore diameter.

The shape and form of the abrasive portion 24 can be varied as desired. It is usually desired to provide grooving in and through the abrasive portions where honing oil can circulate during honing. The method by which the subject mandrel is used can also be varied although existing control devices or machines can be used for some of the applications. In particular, one of the things that distinguishes the present honing method from prior methods is the fact that the mandrel can be inserted and reinserted while retracted into a blind bore to some desired position and withdrawn outwardly during the honing operation as many times as necessary. This can be programmed into a computer controlled honing machine such as that shown in U.S. Pat. No. 4,887,221 entitled COMPUTER CONTROLLED HONING MACHINE or other type of honing machine as required.

The method of honing in blind bores using the present method allows the operator to hone a blind bore using an expandable tapered tool. The taper is made such that the one end of the tool, the end which is first inserted into the blind bore is the larger end. In order to insert the tool it must be retracted as indicated and when the tool has been properly positioned at or near the closed end of the bore, the mandrel will start rotating and the tool is then expanded at a controlled rate. A dwell time can be added if desired to allow the material to be removed by the tool. The expanded rotating tool is then pulled out of the bore as indicated and the appropriate rate will ensure that the workpiece is the same size over the entire bore length. If the amount of material that can be removed is greater than the tool can remove in one pass, the process can be repeated with the tool expanded out to the final diameter on the last pass.

The operator of the honing machine employing the subject device can program the entire sequence of steps by entering a series of parameters for each step. This allows the operator to move the tool in the bore at different rates as necessary. Once the tool is properly positioned in the bore, it is expanded or retracted at different rates as needed and the spindle or mandrel speed can be varied as desired. To accomplish this with a honing machine that is computer controlled, the operator enters the starting diameter, which is the bore size before honing. The final desired bore diameter and the bore length and relief, which is the maximum amount that the tools is allowed to travel relative to the open end of the bore is also entered. The software will give the operator a choice of available tools in this range and the tool can be installed after it has been selected. For example, the operator can establish the end positions of the bore which sets the position of the open or entry end of the bore and can then move the column to the index position. This is the position where it is safe for the workpiece to be transferred under or away from the tool as when the bore is in a vertical position, for example. When this information has been entered, the machine has all of the limits required for the operator to make a safe set up. Also when the limits have been established, the operator will be prevented from entering any undesired data. If the data is entered properly the tool will be prevented from hitting the closed end of the bore and it will also prevent the tool from over expanding. Typically the machine will operate in steps, each step having various parameters that must be entered such as the RPM which will vary depending upon the type of abrasive and material involved as well as the diameter and physical characteristics of the bore and the feed rate which is the rate at which the tool will be withdrawn from the bore. The feed rate must also be selected so as not cause the tool to twist for example. The data will also include the part size, the dwell time which is the amount of time the tool will remain in certain positions before moving and the rate of movement of the tool which may vary depending on the position of the tool in the hole.

Figure 10:
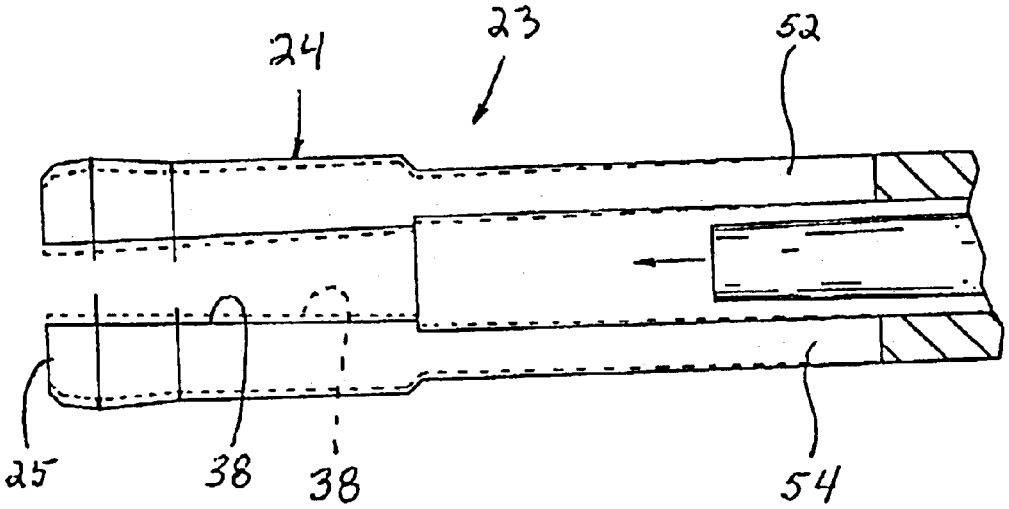
FIG. 10 is an enlarged fragmentary cross-sectional view of the abrasive end portion of a honing mandrel constructed according to the teachings of the invention.

Referring to FIG. 10, there is shown an enlarged cross sectional view of the abrasive end portion 24 of the mandrel shown in dotted outline in retracted condition. In this condition the slots such as slots 42, 44 and 46 in FIG. 1 are shown as straight or axial slots 52 and 54 and in both cases are narrower at the end 25 of the mandrel 22 to reduce the diameter thereat and the conical inner surface 50 is slightly more tapered inwardly than the taper of the conical end portion 38 of the expander member 28. In this retracted position the mandrel can be relatively easily inserted into a blind bore. The outer surface of the abrasive portion 24 is also somewhat smaller in diameter along its length including adjacent to the free end thereof. By so providing the diameter of the abrasive portion adjacent the free end is smaller in diameter than the rest of the abrasive portion but can be expanded outwardly to be made larger in diameter than the rest of abrasive portion 24 when the portion 50 of the expander member 28 is moved into surface-to-surface contact with the inner tapered surface 38. In the inserted position, the abrasive portion can be expanded outwardly so that the diameter of the abrasive portion adjacent to the end will actually be slightly larger than the diameter of the rest of the abrasive portion. Any further movement of the expanded member will further increase the honing diameter to some extent. Also by having the slots in the end portion and making the mandrel 22 of a relatively elastic material, the abrasive portion if properly made will automatically retract itself when the expander member 28 is withdrawn from contact with the conical inner surface 38. By so providing the honing diameter of the abrasive portion can be made to be the largest near the end that is inserted furthest into the blind bore. This is an advantage especially when controlling the operation by means such as a computer controlled honing machine or the like which can be programmed to move the expander member to various desired positions depending on the diameter to be honed by each operation.

An example of such a typical program for honing a blind bore whose initial diameter is 0.2 inches and whose final desired bore diameter is 0.203 inch is now described. If the bore length is selected to be 1 inch the mandrel can for example be rotated initially at 20 RPM and then moved in towards the closed bore end at a rate such as 5 inches per second. When so positioned, the spindle speed is increased such as to about 2000 RPM and the tool is expanded to the starting diameter of 0.2 inch at a rate of about 0.07 inch per minute. It is foreseen that the tool could also be made with the taper opposite to the direction depicted. The tool is then further expanded to 0.2015 inch at a rate of 0.003 inches per minute, the tool will dwell for sometime such as for 2 seconds and then move to the open end of the hole at a rate of about 0.1 inch per second. When the mandrel has reached that position, the tool is retracted to 0.2 inch at a rate of 0.2 inch per minute and then the tool is moved toward the closed end of the bore at a rate of about 5 inches per second. The mandrel speed in then increased again to about 2000 RPM and expanded to 0.2015 inch at a rate of 0.07 inch per minute. The tool is now expanded to 0.203 inch at the same rate of 0.003 inches per minute and again there will be a dwell of approximately 2 seconds prior to moving the tool toward the open end of the bore again at a rate of 0.1 inch per second. When this has been done, the tool is retracted to the initial 0.197 inch at a rate of 0.2 inch per minute and then the tool is moved to the index position for the next operation. The example given above is typical of many different examples which could be done using the same basic steps. Obviously the order and other parameters will vary depending upon how many passes the tool as to make through the bore and the type of abrasive and material involved. The present device can be made to hone a wide range of bore sizes and the size of the components used including the number of slots can be widely varied.

Figure 5:
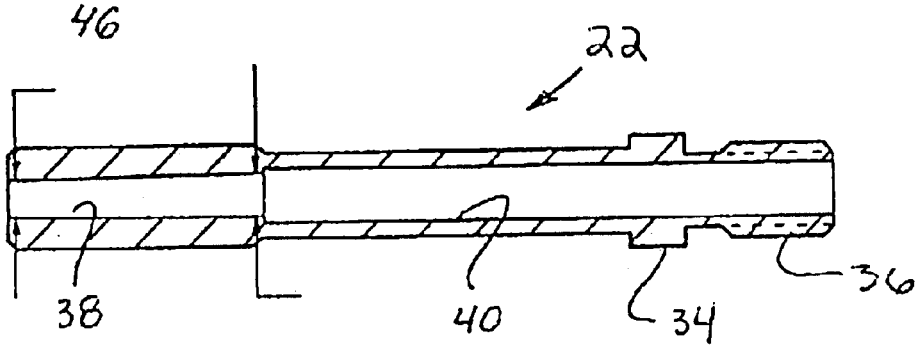
FIG. 5 is a cross-sectional view of the honing member shown in FIG. 2.

It is also possible to apply the principles of the present invention to a tubular mandrel of the general type shown in FIGS. 2 and 5 but wherein a single slot of desired shape extends the full length of the mandrel, and where the end portion of the mandrel where the honing abrasive is located will have a similar conically tapered inner surface similar to the surface 38 which can be expanded or retracted by axially moving a wedge member such as the wedge member 28. This will cause some changes in the diameter of the abrasive portion and hence some difference in the honing diameter.

Another option available with the present invention is to reverse the direction of the taper of the conical surface 38 in the mandrel and to likewise reverse the taper of the end portion of the wedge member to match the reverse taper in the mandrel. To accomplish this the wedge member should be inserted into the mandrel from the opposite end by introducing it into the end of the mandrel that is first inserted into the workpiece bore. In that case, the wedge member would be pulled through the mandrel to expand the diameter rather than pushed to expand the mandrel diameter. In either case, the outer abrasive surface can be similar to the outer abrasive surfaces of the mandrels described above.

A still further option is to make one or more slots in the mandrel which do not extend to either end of the mandrel but are located at least in part where the abrasive is. A similar tapered inner surface can then be provided for engaging by a wedge member. In this construction as in the other construction, the wedge member can be moved in a forward or reverse direction depending upon the diameter of the taper of the inner surface of the mandrel where the slots are located. In this case, the mandrel will bulge out when the wedge member is moved against the tapered inner surface in one direction and will retract when the wedge member is moved in the opposite direction. In each of these constructions, the amount of radial movement of the abrasive particles can be relatively small but sufficient to hone the bore surface to the desired diameter when rotated and when the mandrel is pulled through the bore being honed. On all of these embodiments it is possible to insert and remove the mandrel in a bore by moving the mandrel relative to the workpiece or by moving the workpiece relative to the mandrel.

Thus, there has been shown and described a novel honing mandrel construction for honing blind bores or holes and the like and a novel method of using such mandrel which fulfill all of the objects and advantages sought therefor. It will be apparent to those skilled in the art, however, that many changes, variations, modifications, and other uses and applications of the subject tool and method are possible, and all such changes, variations, modifications, and other uses and applications which do not depart from the spirit and scope of the invention are deemed to be covered by the invention which is limited only by the claims which follow.

What is claimed is:

1. A method for honing a cylindrical blind bore that is open at one end and closed adjacent to the opposite end comprising providing a tubular honing mandrel having a first end portion with a substantially cylindrical outer abrasive surface over the length thereof, said first end portion having a substantially conical inner surface, at least one axially extending slot extending through the first end portion and through part of the adjacent portion of the tubular mandrel, an expander member positioned extending through the honing mandrel and having a conically tapered end portion for movement into surface-to-surface contact with the substantially conical inner surface of the mandrel, the method including the steps of:

programming a computer operated honing machine including the tubular mandrel to control timing of expansion and retraction of the tubular mandrel, and a speed of rotation of the tubular honing mandrel, said programming including establishing a location of the mandrel when inserted into a blind bore to be honed and controlling a rate of movement of the honing mandrel when expanded and being drawn through and from the cylindrical bore, moving the expander member in the honing mandrel axially in a direction to retract the honing diameter so that the mandrel can be inserted into and through the cylindrical bore, advancing the expander member axially in the honing mandrel to force the conical end portion thereof against the conical inner surface of the honing mandrel to cause the honing diameter of the abrasive surface to expand outwardly to bear against the surface of the bore, and withdrawing the expanded honing mandrel from the bore while rotating the honing mandrel to hone the surface of the bore.

2. The method of claim 1 including the further steps of programming into the computer controlled honing machine, the unhoned diameter of the blind bore to be honed, the final dimension of the blind bore after it is honed, and the speed of rotation of the honing mandrel during withdrawal thereof from the blind bore.

3. The method of claim 1 including programming the size of the blind hole to be honed by each honing operation when a honing operation requires more than one pass of the honing mandrel through the bore to reach the final desired blind bore size.

4. The method of claim 1 wherein the maximum diameter of the outer abrasive surface of the tubular honing mandrel is programmed in for each honing operation, the position of the maximum diameter of the abrasive surface being programmed to occur at the beginning of each honing operation after the mandrel is inserted into the blind bore to a position adjacent to the closed end thereof.

5. A method for honing a cylindrical blind bore that is open at one end and closed adjacent to the opposite end comprising providing a tubular honing mandrel, having a first end portion with a substantially cylindrical outer abrasive surface over the length thereof, said first end portion having a substantially conical inner surface, at least one axially extending slot extending through the first end portion and through part of the adjacent portion of the tubular mandrel, an expander member positioned extending through the honing mandrel and having a conically tapered end portion for movement into surface-to-surface contact with the substantially conical inner surface of the mandrel, the method including the steps of:

programming in a computer controlled honing machine including the tubular honing mandrel, the size of the blind bore to be honed by each honing operation when a honing operation requires more than one pass of the honing mandrel through the bore to reach the final desired blind bore size, moving the expander member in the honing mandrel axially in a direction to retract the honing diameter so that the mandrel can be inserted into and through the bore, advancing the expander member axially in the honing mandrel to force the conical end portion thereof against the conical inner surface of the honing mandrel to cause the honing diameter of the abrasive surface to expand outwardly to bear against the surface of the bore, and withdrawing the expanded honing mandrel from the bore while rotating the honing mandrel to hone the surface of the bore to a programmed size.

6. The method of claim 5, further comprising an initial step of programming a computer operated honing machine including the tubular mandrel to control timing of expansion and retraction of the tubular mandrel, and a speed of rotation of the tubular honing mandrel, said programming including establishing a location of the mandrel when inserted into a blind bore to be honed and controlling a rate of movement of the honing mandrel when expanded and being drawn through and from the cylindrical bore.

7. The method of claim 6 including the further steps of programming into the computer controlled honing machine, the unhoned diameter of the blind bore to be honed, the final dimension of the blind bore after it is honed, and the speed of rotation of the honing mandrel during withdrawal thereof from the blind bore.

8. The method of claim 5 wherein the maximum diameter of the outer abrasive surface of the tubular honing mandrel is programmed in for each honing operation, the position of the maximum diameter of the abrasive surface being programmed to occur at the beginning of each honing operation after the mandrel is inserted into the blind bore to a position adjacent to the closed end thereof.

9. A method for honing a cylindrical blind bore that is open at one end and closed adjacent to the opposite end comprising providing a tubular honing mandrel having a first end portion with a substantially cylindrical outer abrasive surface over the length thereof, said first end portion having a substantially conical inner surface, at least one axially extending slot extending through the first end portion and through part of the adjacent portion of the tubular mandrel, an expander member positioned extending through the honing mandrel and having a conically tapered end portion for movement into surface-to-surface contact with the substantially conical inner surface of the mandrel, the method including at least one honing operation including the steps of:

moving the expander member in the honing mandrel axially in a direction to retract the honing diameter so that the mandrel can be inserted into and through the cylindrical bore, advancing the expander member axially in the honing mandrel to force the conical end portion thereof against the conical inner surface of the honing mandrel to cause the honing diameter of the abrasive surface to expand outwardly to bear against the surface of the bore, and withdrawing the expanded honing mandrel from the bore while rotating the honing mandrel to hone the surface of the bore, wherein the maximum diameter of the outer abrasive surface of the tubular honing mandrel is programmed in a computer controlled honing machine which controls the honing operation, the position of the maximum diameter of the abrasive surface being programmed to occur at the beginning of each honing operation after the mandrel is inserted into the blind bore to a position adjacent to the closed end thereof.

10. The method of claim 9, further comprising an initial step of programming a computer operated honing machine including the tubular mandrel to control timing of expansion and retraction of the tubular mandrel, and a speed of rotation of the tubular honing mandrel, said programming including establishing a location of the mandrel when inserted into a blind bore to be honed and controlling a rate of movement of the honing mandrel when expanded and being drawn through and from the cylindrical bore.

11. The method of claim 10 including the further steps of programming into the computer controlled honing machine, the unhoned diameter of the blind bore to be honed, the final dimension of the blind bore after it is honed, and the speed of rotation of the honing mandrel during withdrawal thereof from the blind bore.

12. The method of claim 9 including programming the size of the blind hole to be honed by each honing operation when a honing operation requires more than one pass of the honing mandrel through the bore to reach the final desired blind bore size.

* * * * *